US005701387A

United States Patent [19]

McGugan

[11] Patent Number: 5,701,387

[45] Date of Patent: Dec. 23, 1997

[54] STORAGE TANK WATER HEATER TEMPERING SYSTEM

[76] Inventor: Colin A. McGugan, 866 Ribston Rd., Mississauga, Ontario, Canada, L4Y 1B1

[21] Appl. No.: 359,132

[22] Filed: Dec. 19, 1994

[51] Int. Cl.[6] ..... F24H 1/20

[52] U.S. Cl. ..... 392/456; 236/12.13; 392/461; 392/496; 126/361

[58] Field of Search ..... 392/456, 341, 392/458, 459, 454, 496, 461, 462; 126/361, 362, 344; 165/100, 101, 103, DIG. 109, DIG. 126, 297; 236/12.13; 137/340, 341

[56] References Cited

U.S. PATENT DOCUMENTS

| | | | |
|---|---|---|---|
| 4,498,622 | 2/1985 | Harnish | 126/362 |
| 5,115,491 | 5/1992 | Perlman et al. | 392/454 |
| 5,261,597 | 11/1993 | Perlman et al. | 236/93 R |
| 5,459,890 | 10/1995 | Jarocki | 126/362 |

*Primary Examiner*—Tu B. Hoang
*Attorney, Agent, or Firm*—Ridout & Maybee

[57] ABSTRACT

A hot water tempering system for use with a standard water heater storage tank includes a heat exchanger interposed between the hot water outlet means and the cold water inlet means for transferring heat from hot water exiting from the tank to cold water entering the tank. In this way the temperature of the hot water is tempered. The system is characterized by the fact that the cold water inlet means comprises a first conduit which passes through the heat exchanger to receive heat transferred from the hot water, and a second conduit which bypasses the heat exchanger and delivers cold water directly to the tank. The two inlet conduits are connected to a cold water mains inlet by way of a diverter valve which, in response to the water temperature in the upper region of the tank apportions the water flow between the two conduits. The system enables water to be stored in the tank at a moderately high temperature for demand management purposes and bacterial growth control while minimizing the risk of scalding a user.

8 Claims, 3 Drawing Sheets

STORAGE TANK WATER HEATER TEMPERING SYSTEM

BACKGROUND OF THE INVENTION

The present invention relates to a tempering system for storage tank water heaters which will allow water to be stored in the tank at a relatively high temperature for demand management purposes and bacterial growth control while permitting the supply of water to the user at a tempered temperature to reduce the danger of scalding.

In a direct demand system, such as is commonly used in a domestic water supply, the risk of scalding may be minimized by fixing the maximum temperature to which the water can be heated to a relatively low setting at 60° C. or less. This has the disadvantage that such a tepid water temperature can encourage bacterial growth; furthermore, it is uneconomic as frequent reheating may be required.

In an attempt to overcome these disadvantages, various tempering systems for storage tank water heaters have been proposed. One such system, which has the further advantage that it can be used to modify existing conventional water heater systems, is disclosed in U.S. Pat. No. 5,115,491—Perlman et al.

The tempering system disclosed in the above-mentioned patent of Perlman et al is of the type having a storage tank with heating means, outlet means for conveying heated water to a distribution system on demand, and cold water inlet means for replenishing the tank on demand. A heat exchanger links the outlet means with the cold water inlet means for transferring heat between heated water exiting and cold water entering the storage tank. When the temperature of the water drawn from the tank falls below a certain level, a valve is activated, causing the incoming cold water to bypass the heat exchanger.

SUMMARY OF THE INVENTION

The present invention relates to a modification of the Perlman et al system which will allow water to be stored in the storage tank at a medium temperature somewhat lower than is required in the prior system but still suitable for demand management purposes and bacterial growth control while permitting the supply of tempered water to avoid scalding hazards.

According to the present invention, in a tempering system of the type referred to, the cold water inlet means comprises a first conduit passing through the heat exchanger to receive heat from heated water drawn from the tank, a second conduit bypassing the heat exchanger and communicating with a lower region of the tank for conveying cold water thereto directly, and a three-way diverter valve interconnecting the first and second conduits with a common mains inlet. The diverter valve is operable in accordance with the temperature of water exiting from the storage tank to apportion the cold water flow between the first and second conduits. The temperature of the heated water exiting from the tank is measured by a temperature sensor.

In a preferred embodiment of the invention the diverter valve is a three-way balanced hydronic valve having three operative positions, namely, a first position in which it opens the first conduit and closes the second conduit in response to a water temperature above a set maximum level as measured by the temperature sensor, a second position in which it closes the first conduit and opens the second conduit in response to a water temperature below a set minimum level as measured by the temperature sensor, and an intermediate position in which it divides the cold water flow between the first and second conduits in response to a measured water temperature between the set minimum and maximum levels.

BRIEF DESCRIPTION OF THE DRAWINGS

A preferred embodiment of the invention will now be described, by way of example, with reference to the accompanying drawings. In the drawings.

DESCRIPTION OF THE PREFERRED EMBODIMENTS

Figure 1:
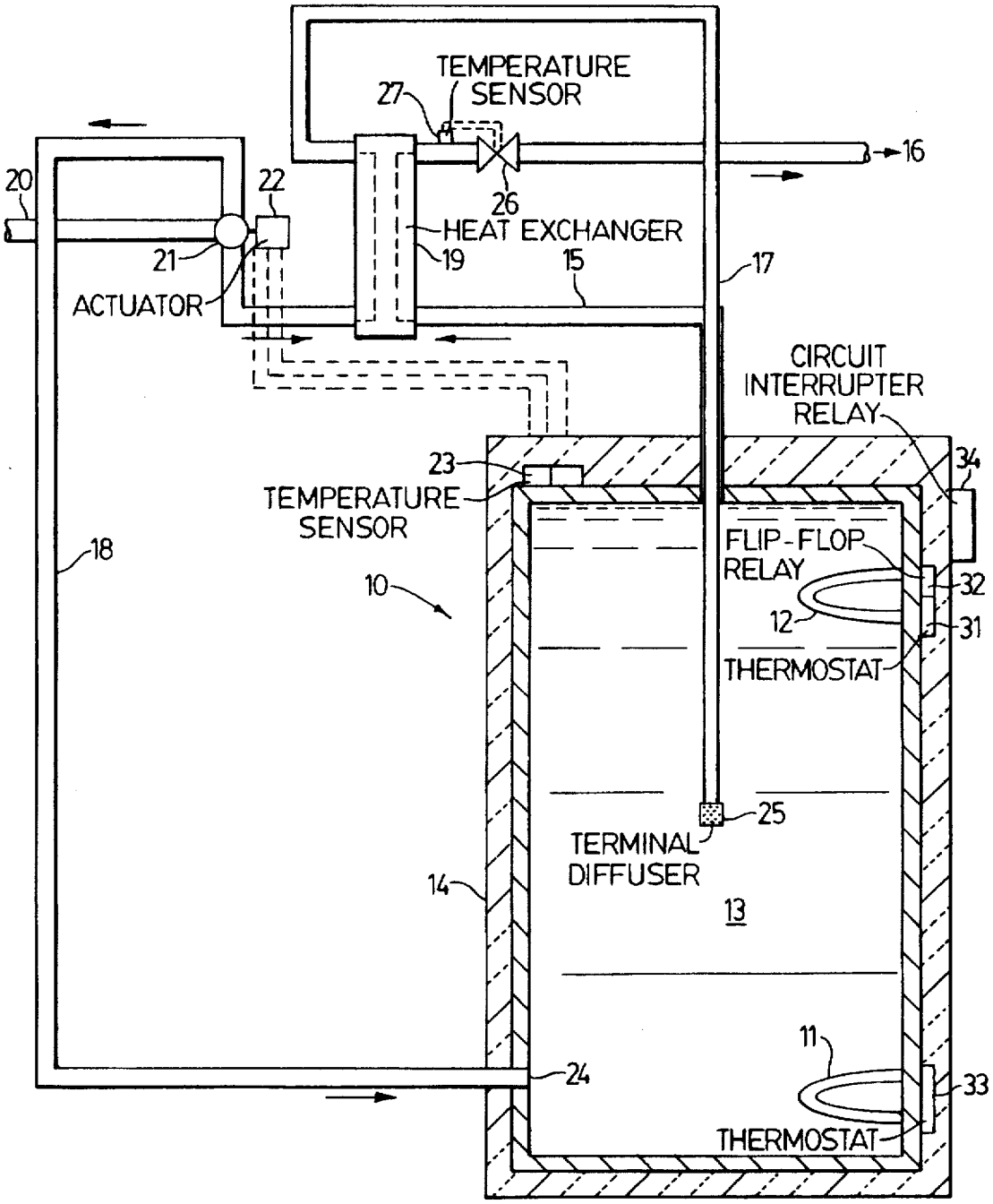
FIG. 1 is a schematic illustration of an electrically operated, direct-demand, domestic hot water tempering system according to the invention.

As previously mentioned, the tempering system of the present invention is a modification of the system described in the U.S. Pat. No. 5,115,491 of Perlman et al, the contents of which are incorporated herein by reference. As shown in FIG. 1, a hot water storage tank 10 is provided with electric heating elements 11, 12 located in the lower and upper regions, respectively, of the tank storage space 13, the heating elements being interconnected with a power supply 30, as hereinafter described, for heating a body of water in the tank. The tank 10 is encased in an insulating material 14, such as glass fibre, to minimize heat dissipation from the stored hot water.

The system provides an outlet conduit 15 communicating with the upper region of the storage tank for conveying heated water to a distribution system 16 on demand, cold water inlet means 17, 18 for replenishing the tank on demand, and a heat exchanger 19 linking the outlet conduit 15 with the cold water inlet means for transferring heat from the heated water exiting from the tank to the cold water entering the tank. According to the present invention the cold water inlet means comprises a first inlet conduit 17 and a second inlet conduit 18, the two inlet conduits being interconnected with a common mains inlet 20 by way of a diverter valve 21, as hereinafter described.

The heat exchanger is interposed between the cold water inlet conduit 17 and the outlet conduit 15. The heat exchanger 19 is preferably a brazed plate heat exchanger of the kind described in the above-mentioned Perlman et al patent. The two conduits 15, 17 pass through the heat exchanger, which provides a heat conduction medium for transferring heat between the outlet conduit 15 and the first inlet conduit 17, so that the two conduits do not come into direct contact but are spaced apart. The preferred flow of the fluid conveyed by the conduits 15, 17 through the heat exchanger is co-current, that is to say, in the same direction.

As a consequence of travelling through the heat exchanger, the hot water in the outlet conduit 15 is tempered, and heat transferred to the first inlet conduit 17 warms the incoming cold water. Preferably the heat transfer is complete and the water exiting from the heat exchanger in both conduits is at a uniform temperature.

The inlet conduits 17, 18 are connected to the common mains inlet 20 by the diverter valve 21, having an actuator 22, which is responsive to and operable by a temperature sensor 23 mounted on the tank 10. The temperature sensor 23 is positioned so as to respond to the water temperature in the upper region of the tank. The diverter valve is preferably a three-way balanced hydronic valve, such as a valve of the VC series produced by Honeywell. The valve has a common inlet connected directly to the common mains inlet 20, a first outlet connected to the first inlet conduit 17, and a second outlet connected to the second inlet conduit 18. The diverter valve 21 has three operative positions to which it is set by the actuator 22 in response to the hot water temperature measured by the temperature sensor 23. Thus, when the temperature of the water in the upper region of the tank, as sensed by the temperature sensor 23, rises above a set maximum level, the valve is moved by the actuator to a first operative position in which it opens the first inlet conduit 17 and closes the second inlet conduit 18 so as to divert all the incoming cold water through the heat exchanger 19. When the temperature of the hot water in the upper region of the tank falls below a set minimum level, as sensed by the temperature sensor 23, the valve is moved to a second operative position in which it closes the first inlet conduit 17 and opens the second inlet conduit 18 so as to divert all the incoming cold water through the inlet conduit 18. The inlet conduit 18 bypasses the heat exchanger 19 and is connected to a tank inlet 24 communicating with the lower region of the tank 10 for conveying the incoming cold water directly thereto.

When the temperature sensor 23 indicates a hot water temperature between the set maximum and minimum levels, the diverter valve 21 is moved to an intermediate position in which it divides the incoming cold water flow between the first and second inlet conduits.

The first inlet conduit 17 terminates at an intermediate region of the tank storage space 13 between the upper and lower regions, and is fitted with a terminal diffuser 25 for diffusing the incoming preheated water into the intermediate region.

As an additional safety feature to prevent scalding water entering the distribution system, an independent safety shut-off valve 26 and temperature sensor 27 are located in the outlet conduit 15 between the heat exchanger 19 and the distribution system 16. The shut-off valve 26 is responsive to the temperature sensor 27 and is operable to close the outlet conduit 15 and thereby shut off the supply of water to the distribution system when the supplied water exceeds a set maximum temperature level.

Figure 2:
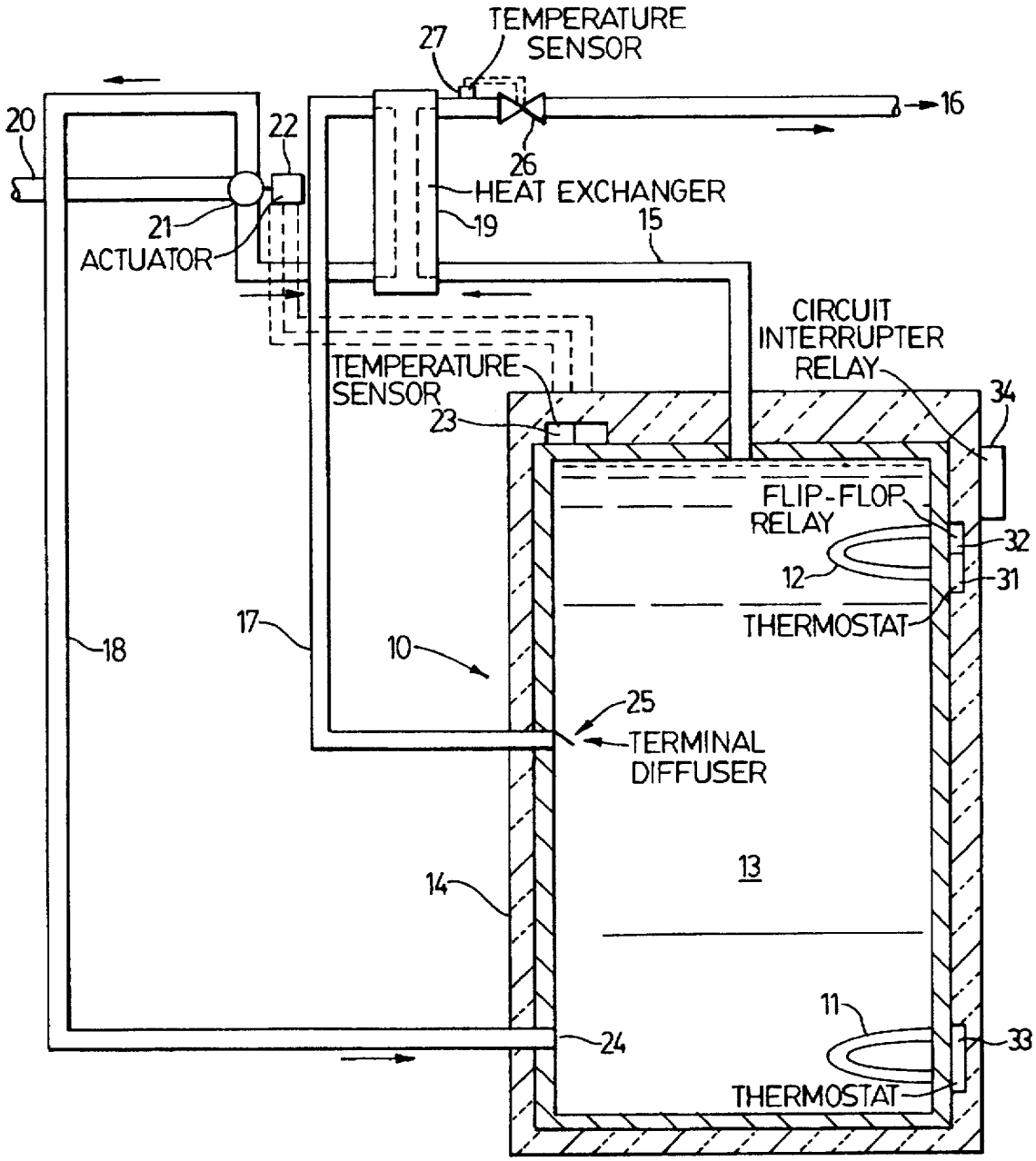
FIG. 2 illustrates the tempering system of FIG. 1 but showing an alternative water inlet connection.
Figure 3:
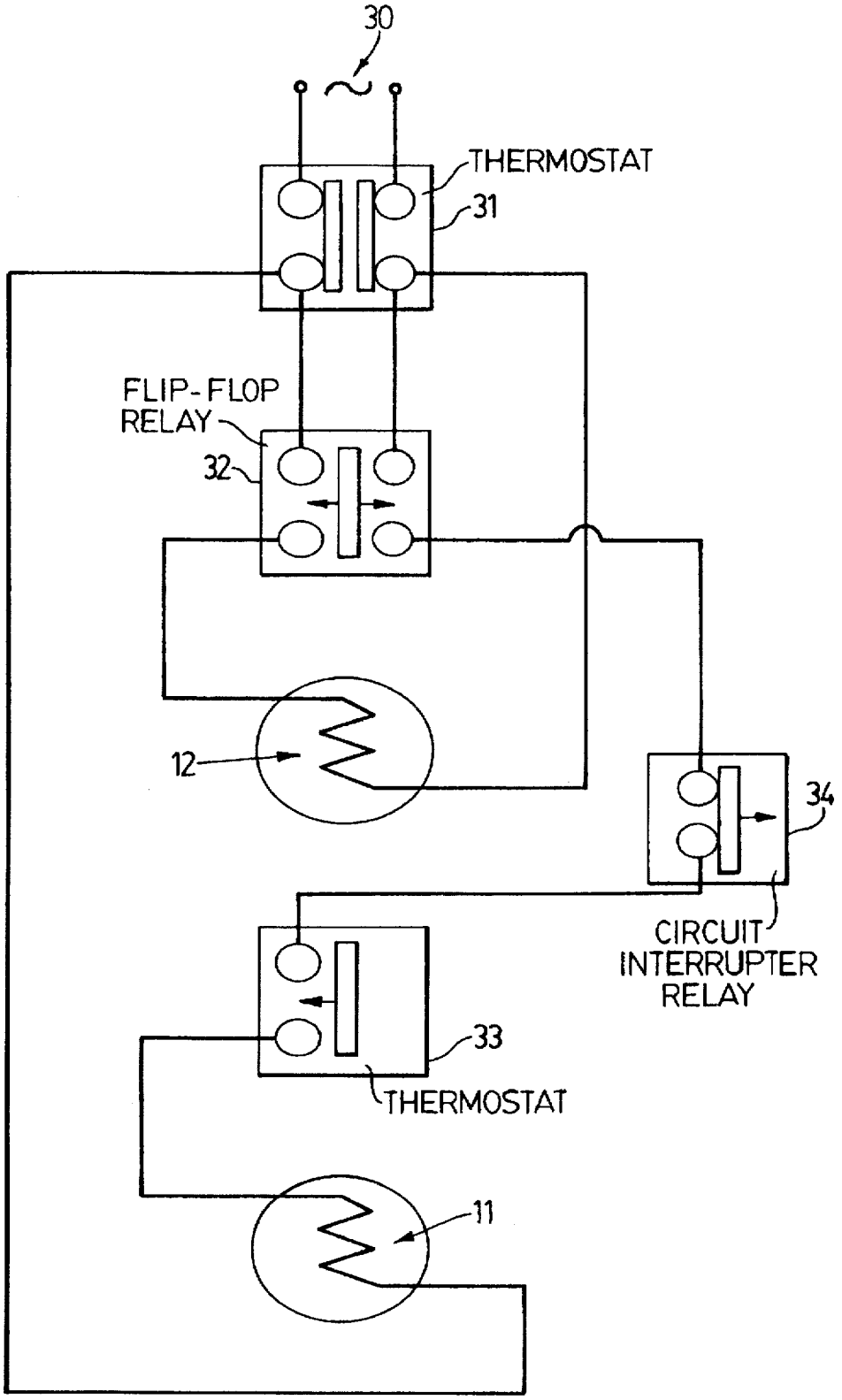
FIG. 3 is a schematic wiring diagram showing the electrical connections to the heating elements.

Referring now also to FIG. 2, the power supply 30 is connected through a high temperature limit control thermostat 31, which automatically shuts off the power supply 30 on sensing water in the tank 10 exceeding a set maximum limiting temperature. This maximum limiting temperature in domestic hot water supply systems will be determined by government standards. In North America, standards for domestic water heaters are generally set between 90° and 96° C. (194° and 205° F.), while for commercial systems not subject to such controls, the maximum limiting temperature could be even higher where the tank has been constructed of suitable material.

The power connection to the heating elements 11 and 12 is through a double-throw or flip-flop relay 32 which incorporates a thermostat to open a connection with one of the heating elements when the temperature of the water in the tank falls below a set minimum, generally a tepid set point of 50° to 60° C. (122° to 140° F.)

Only one of the heating elements 11 or 12 will be activated at a time. The element 12 will normally be operated until water in the tank is heated to the set point of the thermostat 31. The thermostat will then activate the relay 32 to disconnect the power supply from the element 12, and provide power to the thermostat 33.

According to the invention, a demand control device in the form of a circuit interrupter relay 34, normally closed, connects the relay 32 to the lower thermostat 33. When closed, the circuit interrupter enables operation of the thermostat 33 to sense the temperature of water in the storage tank around the element 11, and to activate the element 11 if the temperature of the water falls below the set minimum, generally a tepid 50° to 60° C. (122° to 140° F.). When open, then, the circuit interrupter 34 disables the thermostat 33, and indirectly prevents activation of the element 11.

To sum up, the operation of the system is as follows. During off-peak periods, water in the storage tank 10 is heated to 75° C. by the lower heating element 11, controlled by the lower thermostat 33. When hot water is drawn off, the water flows from the tank 10 via the outlet conduit 15, heat exchanger 19, and shut-off valve 26. As long as the water passing the shut-off valve 26 is below 65° C., as measured by the temperature sensor 27, the shut-off valve will remain open, but will close if that temperature is exceeded. Cold water from the common mains inlet 20 must flow through the diverter valve 21. If the hot water temperature sensed by the temperature sensor 23 is above 77° C., the incoming cold water is diverted via the inlet conduit 17 through the heat exchanger, thereby to temper the hot water exiting from the tank. If the water temperature is between 63° C. and 77° C., the diverter valve 21 moves to its intermediate position so that the incoming water flow is divided between the two inlet conduits 17, 18. If the temperature of the water drawn from the tank is below 63° C., the diverter valve is moved to its second operative position whereby to divert all the incoming cold water via the second inlet conduit 18 to the tank inlet 24.

During peak periods, electrical power to the lower heating element 11 and thermostat 33 is cut off by the circuit interrupter relay 34. If the temperature of the water sensed by the upper thermostat 31 falls below 50° C., the upper heating element 12 is activated to heat the water above the element to 50° C.

The high temperature limit thermostat is activated if the water temperature in the upper region of the tank rises above 94° C., so as to shut off the power supply from the heating elements. If the power supply to the heating elements is interrupted, the diverter valve 21 and safety shut-off valve 26 remain in the positions they were in before the power interruption. The timer controller has a battery backup to maintain the clock time for extended periods thereby ensuring that the water heater will resume normal operation when the power supply is reconnected.

I claim:

1. A tempering system for a hot water storage tank providing an internal storage space with heating means located in a lower region of the storage space and a temperature sensor responsive to water temperature in an upper region of the storage space, outlet means communicating with said upper region of the storage space for conveying heated water to a distribution system on demand, cold water inlet means for replenishing the hot water storage tank on demand, and a heat exchanger linking said outlet means with the cold water inlet means for transferring heat from the heated water to cold water entering the hot water storage tank, wherein the cold water inlet means comprises a first conduit passing through the heat exchanger whereby to receive transferred heat, a second conduit bypassing the heat exchanger and communicating with the lower region of the storage space for conveying water directly to the lower region, and a diverter valve interconnecting said first and second conduits with a common mains inlet, the diverter valve being responsive to and operable by the temperature sensor whereby to apportion the cold water flow between said first and second conduits in accordance with the temperature of water exiting from the hot water storage tank.

2. A tempering system according to claim 1, wherein the diverter valve is a three-way balanced hydronic valve having an inlet for connection to said common mains inlet, and first and second outlets connected respectively to said first and second conduits.

3. A tempering system according to claim 2, in which the diverter valve is movable to a first operative position in which it opens said first conduit and closes said second conduit in response to the temperature sensor indicating a water temperature above a set maximum level, a second operative position in which it closes said first conduit and opens said second conduit in response to the temperature sensor indicating a water temperature below a set minimum level, and an intermediate operative position in which it divides the cold water flow between said first and second conduits in response to the temperature sensor indicating a water temperature between said set minimum and maximum levels.

4. A tempering system according to claim 3, wherein the first conduit of said cold water inlet means enters said storage space at an intermediate region between said upper and lower regions.

5. A tempering system according to claim 4, wherein said first conduit is terminated by means for diffusing the incoming water into said intermediate region of the tank storage space.

6. A tempering system according to claim 1, including a shut-off valve and a second temperature sensor located in said outlet means, the shut-off valve being responsive to and operable by said second temperature sensor for closing said outlet means when the temperature of the heated water conveyed by the outlet means exceeds a set maximum level.

7. A tempering system according to claim 1, wherein said heating means comprises a first electric heating element located in said lower region of the storage space and circuit means interconnecting said first electric heating element with a power supply, said circuit means including a circuit interrupter relay operable to disconnect the heating element during selected time periods.

8. A tempering system according to claim 7, including a second electric heating element located in the upper region of the storage tank, wherein said circuit means includes a flip-flop relay responsive to water temperature in the upper region of the storage tank and operable to connect the second heating element to the power supply and disconnect the first heating element from the power supply when the water temperature in the upper region of the storage tank falls below a set minimum level.

* * * * *